US009591882B2

(12) United States Patent
Duffin

(10) Patent No.: US 9,591,882 B2
(45) Date of Patent: Mar. 14, 2017

(54) ABSORBENT SLEEVE

(76) Inventor: Robert LaGrand Duffin, Draper, UT (US)

( * ) Notice: Subject to any disclaimer, the term of this patent is extended or adjusted under 35 U.S.C. 154(b) by 776 days.

(21) Appl. No.: 13/198,250

(22) Filed: Aug. 4, 2011

(65) Prior Publication Data

US 2012/0030858 A1 Feb. 9, 2012

Related U.S. Application Data

(60) Provisional application No. 61/371,029, filed on Aug. 5, 2010.

(51) Int. Cl.

| | |
|---|---|
| ***A42B 1/00*** | (2006.01) |
| ***A42B 3/04*** | (2006.01) |
| ***A42B 1/06*** | (2006.01) |
| ***A42B 1/04*** | (2006.01) |

(52) U.S. Cl.

CPC ..... *A42B 3/0406* (2013.01); *A42B 1/00* (2013.01); *A42B 1/04* (2013.01); *A42B 1/06* (2013.01)

(58) Field of Classification Search

CPC ..... A42B 1/00; A42B 1/04; A42B 1/06
USPC ..... 2/183, 174, 68, 417, 418, 171, 202, 204, 2/207, 208, 67, 205; D2/867, 881, 865; 132/200, 212, 274
See application file for complete search history.

(56) References Cited

U.S. PATENT DOCUMENTS

| | | | | |
|---|---|---|---|---|
| 2,263,418 | A | | 11/1941 | Ganim |
| 4,641,380 | A | | 2/1987 | Epstein |
| 4,937,885 | A | | 7/1990 | Gregg |
| 5,007,115 | A | | 4/1991 | Denbow et al. |
| 5,109,548 | A | | 5/1992 | Balaban et al. |
| 5,490,528 | A | | 2/1996 | Day |
| 5,765,230 | A | | 6/1998 | Sivret et al. |
| 5,822,800 | A | | 10/1998 | Anderson |
| 5,920,909 | A | | 7/1999 | Ellsworth et al. |
| 5,933,871 | A | | 8/1999 | Kraft |
| 5,960,478 | A | * | 10/1999 | Sivret et al. ..... 2/202 |
| 6,560,784 | B2 | | 5/2003 | Hill |
| 7,181,775 | B2 | | 2/2007 | Carney |
| 2005/0066415 | A1 | | 3/2005 | Adkins |
| 2005/0241093 | A1 | | 11/2005 | McKenzie |

OTHER PUBLICATIONS

Tassy,LLC.,"Tassy Hair accessories", USA via Web www.tassicompany.com/shop/Tassi_Hair_Accessories_Hair_Care_Products_no_more_hair_bands_or_hassles.pdf.
Turbie Twist,LLC. "Turbie Twist", USA via web at http://www.turbietwist.com/The Original Turbie Twist® Hair Towel—How to Use.pdf.

* cited by examiner

*Primary Examiner* — Khaled Annis
(74) *Attorney, Agent, or Firm* — Jason P. Webb; Pearson, Buller & Carson PLLC

(57) ABSTRACT

An absorbent sleeve configured to rest above a shoulder of a user and enable a user to envelop a user's head, thereby enabling the user to absorb fluids disposed thereon by manual manipulation thereof, without the sleeve being in substantial contact with other parts of a user's body. The sleeve includes a cylindrical member having a looped layer of absorbent material. The cylindrical member includes a first aperture and a second aperture. The absorbent sleeve includes a first cinch loop coupled about the first aperture of the cylindrical member. The absorbent sleeve includes a second cinch loop coupled about the second aperture of the cylindrical member. The cylindrical member includes a waterproof layer disposed on an exterior surface thereof.

7 Claims, 7 Drawing Sheets

ABSORBENT SLEEVE

CROSS-REFERENCE TO RELATED APPLICATIONS

This invention claims priority, under 35 U.S.C. §120, to the U.S. Provisional Patent Application No. 61/371,029 to Robert LaGrand Duffin filed on Aug. 5, 2010, which is incorporated by reference herein.

BACKGROUND OF THE INVENTION

Field of the Invention

The present invention relates to drying apparatuses, specifically to an absorbent sleeve to dry and warm a user's face, hair, and head.

Description of the Related Art

A towel is a piece of absorbent fabric or paper used for drying or wiping. It draws moisture through direct contact, often using a blotting or a rubbing motion. Common household textile towels are made from cotton, rayon, bamboo, nonwoven fibers or a few other materials. A bath towel is used for drying the body after bathing, showering or swimming. It is typically rectangular, with a typical size around 30"×60" (75×150 cm). A large bath towel is sometimes called a bath sheet. Some improvements have been made in the field. Examples of references related to the present invention are described below in their own words, and the supporting teachings of each reference are incorporated by reference herein:

U.S. Pat. No. 5,490,528, issued to Day, discloses a fitted hair towel (1) for drying hair naturally, thereby avoiding the damaging effects associated with typical electric heat drying apparatus. The fitted hair towel (1) is adapted to fit securely on the head so that it can be worn during any activity undertaken by the wearer without restricting the range of motion. An elasticized top edge (3) of the towel member (2) is wrapped from the back of the head at the hairline around the sides of the head to the forehead where inverted corners are secured by fasteners (8). The towel member (2) is wrapped around the hair to form a towel tube (19). The towel tube (19) is twisted and wrapped over the top and against the back of the wearer's head. A strap member (3) at the bottom edge (4) of the towel member (2) is pulled to draw together openings (14) located at the bottom edge (4), thereby gathering the bottom edge (4). Opposing ends (19 and 20) of the strap member (13) are wrapped around either side of the wearer's head and cooperative fastening means (17 and 18) are engaged at the wearer's forehead to secure the towel member (2) in a wrapped configuration.

U.S. Pat. No. 4,937,885, issued to Gregg, discloses a head covering for configuration as a hat or headband that consists of a right circular cylindrical fabric body (11) with a sleeve (12) formed around the cylinder top end wherein is threaded a drawstring (13). The drawstring is to collapse the sleeve upon itself, closing the cylinder top end, which drawstring may include an arrangement for maintaining the drawstring in a tension state, the cylindrical body further including fasteners for maintaining the cylinder in a folded state as a headband.

U.S. Pat. No. 4,641,380, issued to Epstein, discloses an article of headwear convertible between use as a hat and a neck covering is provided. The article of headwear generally comprises a tubular covering of knitted fabric having a closeable side slit and a closeable end. When the side slit and end are both opened, the article is utilizable as a neck covering. When both are closed, the article is utilizable as a hat. If desired, when the side slit is closed but the ends are opened, the article may be formed into an armband for storage. In the preferred embodiment, folds may be formed in a crown portion of the hat to form a hat with a somewhat pointed or truncated crown. Methods of converting a skier's-type hat to an article of neckwear, or vice versa, are also described.

U.S. Pat. No. 7,181,775, issued to Carney, discloses a maternity wear of the invention accommodates the changing shape of a woman's body during pregnancy, minimizing the need for maternity clothes. In one aspect of the invention, pants or a skirt are worn with the upper end unfastened so as to conform to the shape of the swelling torso in pregnancy, and an elastic band shaped similarly to a tube top is worn generally around the waist, so as to overlap the top of the unfastened pants or skirt and retain them on the body. A top, such as a blouse or shirt, can be worn with its tail end extending over the band. In another aspect of the invention, too-large maternity clothing is worn with the band garment engaged over the upper end. If desired the band garment can be folded over on itself, thus doubling its thickness.

U.S. Patent Application Publication No.: 2005/0241093, by McKenzie, discloses an ergonomically designed cylindrically configured wiping towel with two open ends, constructed with multiple, pre-selected exterior areas of varied colors and patterns for user awareness of soiled portions in order to discourage possible cross contamination. The cylindrically structured tube towel is designed to provide the same amount of cleaning surface as a flat conventional towel in a more compact maneuverable, controlled manner. The cylindrically configured wiping towel turns inside out in order to utilize all towel surfaces.

The inventions heretofore known suffer from a number of disadvantages which include being limited in use, being difficult to use, being ineffective, being inefficient, being expensive, being bulky, being used on all parts of a body and thereby transferring undesirable materials therebetween, being uncomfortable, being likely to fall to the floor and thereby be soiled or wetted, and the like.

What is needed is sleeve drying apparatus that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available head towels. Accordingly, the present invention has been developed to provide an absorbent sleeve to dry a user's head, face, and hair.

According to one embodiment of the invention, there is an absorbent sleeve that may be configured to rest above a shoulder of a user and may enable a user to envelop a user's head, thereby enabling the user to absorb fluids that may be disposed thereon by manual manipulation thereof, without the sleeve being in substantial contact with other parts of a user's body. The sleeve may include a cylindrical member that may have a cross-sectional area between about 180 cm^2, 200 cm^2, 250 cm^2, 275 cm^2, 325 cm^2, 350 cm^2, 400 cm^2, and/or about 450 cm^2. The cylindrical member may include a height between about 20 cm, 21 cm, 22 cm, 23 cm, 24 cm, 25 cm, 26 cm, 27 cm, 28 cm, 29 cm, and/or about 30 cm. The cylindrical member may have a looped layer of absorbent material. The cylindrical member may include a first aperture through a first end of the cylindrical member. The cylindrical member may further include a second aperture through a second end of the cylindrical member, opposite the first end.

The absorbent sleeve may include a first cinch loop that may be coupled about the first aperture of the cylindrical member. The first cinch loop may include a first mode, wherein a cross-sectional area of the first cinch loop may be substantially smaller than the cross-sectional area of the cylindrical member. The first cinch loop may include a second mode, wherein a cross-sectional area of the first cinch loop may be substantially equal to the cross-sectional area of the cylindrical member. The first cinch loop may be a drawstring.

The absorbent sleeve may include a second cinch loop that may be coupled about the second aperture of the cylindrical member. The second cinch loop may include a first mode, wherein a cross-sectional area of the second cinch loop may be substantially smaller then the cross-sectional area of the cylindrical member. The second cinch loop may include a second mode, wherein a cross-sectional area of the second cinch loop may be substantially equal to the cross-sectional area of the cylindrical member. The second cinch loop may include a drawstring The cylindrical member may include a waterproof layer disposed on an exterior surface thereof. The cylindrical member may include a coupling member that may be disposed about the first cinch loop or a first end. The cylindrical member may include a receiving member that may be disposed about the second cinch loop or a second end and may be configured to selectably couple to the coupling member. The absorbent sleeve may include a hood that may be coupled to the cylindrical member and may be configured to be disposed over the first aperture. The absorbent sleeve may include a padded member that may be disposed substantially around the first aperture and may be configured to provide a cushion for a forehead region of a user.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
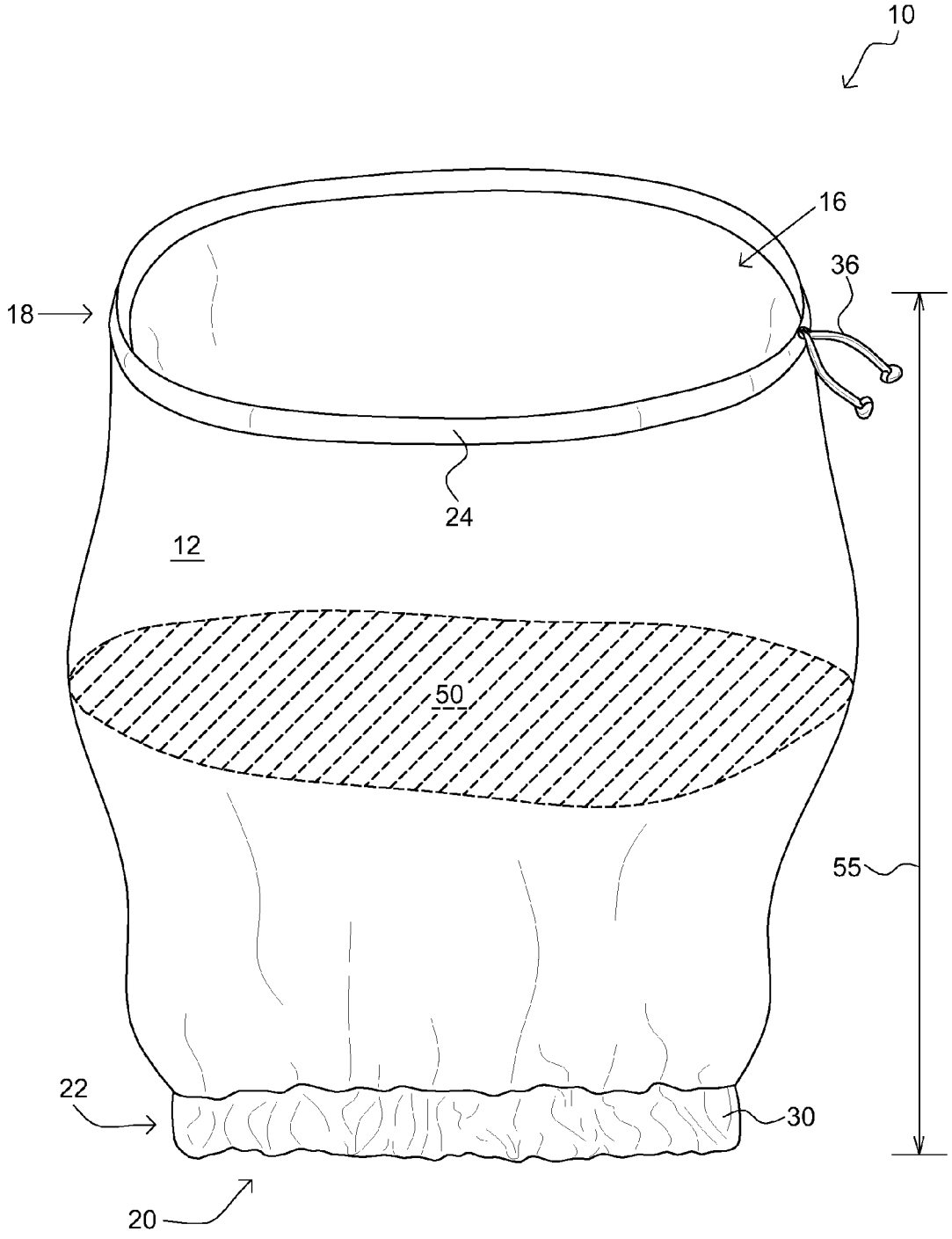
FIG. 1 is a perspective view of an absorbent sleeve, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a perspective view of an absorbent sleeve, according to one embodiment of the invention. There is shown an absorbent sleeve 10 including a cylindrical member 12 having a height 55 and coupled to a pair of cinch loops 24 and 30 that are configured to reduce an effective cross-sectional area of the sleeve in varying manners.

The illustrated absorbent sleeve 10 is configured to rest above a shoulder of a user and enable a user to envelop a user's head, thereby enabling the user to absorb fluids disposed thereon by manual manipulation thereof, without the sleeve being in substantial contact with other parts of a user's body.

The absorbent sleeve 10 includes a cylindrical member 12 that may have a cross-sectional area between about 180 cm^2 and about 450 cm^2 50. Wherein the cylindrical is strictly cylindrical, the cross-sectional area may be calculated according to standard geometric means, such as but not limited to by taking the circumference of the perimeter of the cylindrical member measured along a region substantially orthogonal to the vertical axis of the cylinder and multiplying it by itself and then dividing by the product of 4 and Pi. Similar measurements and calculations may be applied where the cylindrical member is not strictly cylindrical. The sleeve may include a cylindrical member that may have a cross-sectional area between about 180 cm^2, 200 cm^2, 250 cm^2, 275 cm^2, 325 cm^2, 350 cm^2, 400 cm^2, and/or about 450 cm^2. Such a sleeve may be shaped and/or sized to permit a majority of head shapes and sizes to traverse the interior of the cylindrical member and to be substantially contained therein.

The cylindrical member 12 may include a height between about 20 cm and about 30 cm 55. The cylindrical member may include a height between about 20 cm, 21 cm, 22 cm, 23 cm, 24 cm, 25 cm, 26 cm, 27 cm, 28 cm, 29 cm, and/or about 30 cm. The illustrated cylindrical member 12 includes a looped layer of absorbent material. The absorbent material may include: cotton, terry cloth, wool, textiles, fabric, synthetic materials, or the like or combinations thereof. There may be a water-proof or water resistant layer disposed on an exterior surface, interior surface, and/or sandwiched between absorbent layers. Such may include a thin layer of plastic, Gore-Tex® brand water-proof material, nylon, vinyl, or the like or combinations thereof. The illustrated cylindrical member 12 includes a first aperture 16 through a first end 18 of the cylindrical member 12. The cylindrical member 12 further includes a second aperture 20 through a second end 22 of the cylindrical member 12, opposite the first end 18. The cylindrical member may be shaped to include a middle region having a higher natural cross-sectional area than either/both top and bottom regions. This may be accomplished by forming the cylindrical member out of a looped material having a general rectangular shape that bulges in a middle region, looking somewhat like an oval or egg-shaped material having top and/or bottom curves cut to generally straight edges.

An exterior of the cylindrical member may be decorated by sewing fabric to the outside surface, painting, dying, or using pre-patterned fabric therein.

The illustrated absorbent sleeve 10 includes a first cinch loop 24 coupled about the first aperture 16 of the cylindrical member 12. The first cinch loop 24 includes a first mode, wherein a cross-sectional area of the first cinch loop is substantially smaller than the cross-sectional area of the cylindrical member 12. The first mode of the first cinch loop 24 may generate an effective cross-sectional area that is between about 8%, 10%, 15%, 20%, 25%, 30%, 40%, 50%, 60%, 70%, 80%, 90%, and/or 95% that of the effective cross-sectional area 50 of the cylindrical member 12. The first mode of the first cinch loop may effectively close off the aperture completely. Such may be advantageous when desiring to contain hair therein. The first cinch loop 24 includes a second mode, wherein a cross-sectional area of the first cinch loop is substantially equal to the cross-sectional area of the cylindrical member 12. In such a mode a user is permitted to freely pass their head therethrough in much the same manner that they do when interacting with the cylindrical member. The illustrated first cinch loop 24 is a drawstring 36. The first cinch loop 24 may include a selectably determinable cross-sectional area restriction device that rigidly sets an effective cross-sectional area of the loop 24 such that the first cinch loop may be set to either the first or the second mode without continual application of external force. As a non-limiting example, such may be structured to include a channel having a ribbon/cord/robe/thread 36 disposed therein with portions extending outside of the channel through an aperture and including a cinching device/arrangement/mechanism such that the ribbon/etc. may be retracted from the channel and set to resist a return of the ribbon/etc. to the channel, thereby shortening the effective length of the ribbon/etc., thus the effective circumference of the channel and thereby the effective cross-sectional area of the region. Other non-limiting examples include structures including clips, pins, snaps, reels, ratcheting devices, ties, and the like and combinations thereof. Such may be a selectably adjustable cinching device having a plurality of stable modes, each mode having a different effective length/circumference.

The absorbent sleeve 10 includes a second cinch loop 30 coupled about the second aperture 20 of the cylindrical member 12. The second cinch loop 30 includes a first mode, wherein a cross-sectional area of the second cinch loop is substantially smaller than the cross-sectional area of the cylindrical member 12. The first mode of the second cinch loop 30 may generate an effective cross-sectional area that is between about 8%, 10%, 15%, 20%, 25%, 30%, 40%, 50%, 60%, 70%, 80% and/or 90% that of the effective cross-sectional area 50 of the cylindrical member 12. The second cinch loop 30 includes a second mode, wherein a cross-sectional area of the second cinch loop is substantially equal to the cross-sectional area of the cylindrical member. As illustrated, the second cinch loop 30 includes an elastic material configured to expand to fit over a user's head. The second cinch loop may include an elastic member or bias member that, in a resting mode, generates the first mode, wherein force must be applied and/or maintained to generate the second mode. As a non-limiting example, such may be structured to include a channel having a looped elastic member disposed therein, wherein the rest-length of the elastic member is less than the maximum length of the channel. Other non-limiting examples include an elastic member coupled to an end portion of the cylindrical member, staggered elastic members coupled thereto and between towel portions (crenelated/notched), and an increased elastic fiber density as compared to inelastic fibers. Such may be a biased cinching device having a rest mode of a particular effective length and a plurality of strained modes having a plurality of effective lengths different from that of the rest mode.

In operation of one embodiment of the invention, a user takes a shower or a bath and prepares to dry their face and hair afterwards. The user disposes the absorbent sleeve over the user's head and disposes the absorbent sleeve around the neck region of the user by positioning the head through the first and second apertures of the cylindrical member. The user pulls out their hair from the absorbent sleeve thereby disposing the hair outside thereof. The user pulls the absorbent sleeve back over the user's face through the second aperture and dries the user's face with the interior surface of the absorbent sleeve. Wherein the user has long hair, the hair is then hanging outside and over a back portion of the sleeve. The user then pulls the absorbent sleeve over the user's face through the first aperture and disposes the absorbent sleeve over the user's hair. The user dries the hair with the interior of the absorbent sleeve. The absorbent sleeve is configured to securely hold the user's hair away from the user's face. FIGS. 3-9 show non-limiting exemplary embodiments of operational uses of an embodiment of the invention.

Advantageously, a user may restrict usage of the towel to the head region of a person, thereby preventing oils, fluids, microbes, detritus and the like from soiling the towel and/or coming in contact with the head/face of a user. Additionally, the head towel as illustrated may rest about the head and neck of a user in a stable position such that typical activities by the user are not likely to dislodge the head towel where it could fall on the floor or other surface and become soiled. More, the operational characteristics of the first and second cinch loops facilitate the use thereof and permit convenient and easy operation. More, the static adjustability of the first cinch loop such that either the first or the second mode may be made to be "resting" or stable modes prevents the head towel from choking a user, from invoking a gag response by inappropriately stimulating the upper neck region of the user, or otherwise causing discomfort or frustration, while still permitting the first cinch member to have a very wide range of modes that may be restricted strongly.

Figure 2:
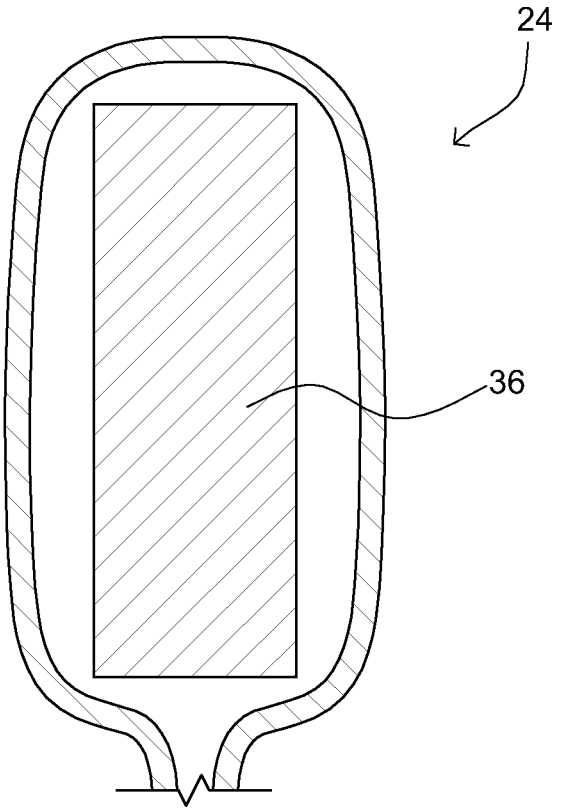
FIG. 2 is a cross-sectional view of a first cinch loop of an absorbent sleeve, according to one embodiment of the invention.

FIG. 2 is a cross-sectional view of a first cinch loop of an absorbent sleeve, according to one embodiment of the invention. There is shown a first cinch loop 24 of an absorbent sleeve forming a channel with a drawstring disposed therein. Such is substantially similar in cross-sectional structure to a second cinch loop having an elastic member disposed therein.

The illustrated first cinch loop 24 is coupled about a first aperture of a cylindrical member of the absorbent sleeve. The first cinch loop 24 includes a drawstring 36. The drawstring 36 is configured to be disposed within the first cinch loop 24. The drawstring 36 is configured to expand and retract the first aperture of the cylindrical member. The illustrated drawstring is free from direct coupling to the loop 24 or other restrictive structures in that it may pass freely therethrough even though it is substantially captured therein. The drawstring 36 is configured to position the first cinch loop 24 in a first mode, wherein a cross-sectional area of the first cinch loop is substantially smaller than the cross-sectional area of the cylindrical member. The drawstring 36 is configured to position the first cinch loop in a second mode, wherein a cross-sectional area of the first cinch loop is substantially equal to the cross-sectional area of the cylindrical member.

Figure 3:
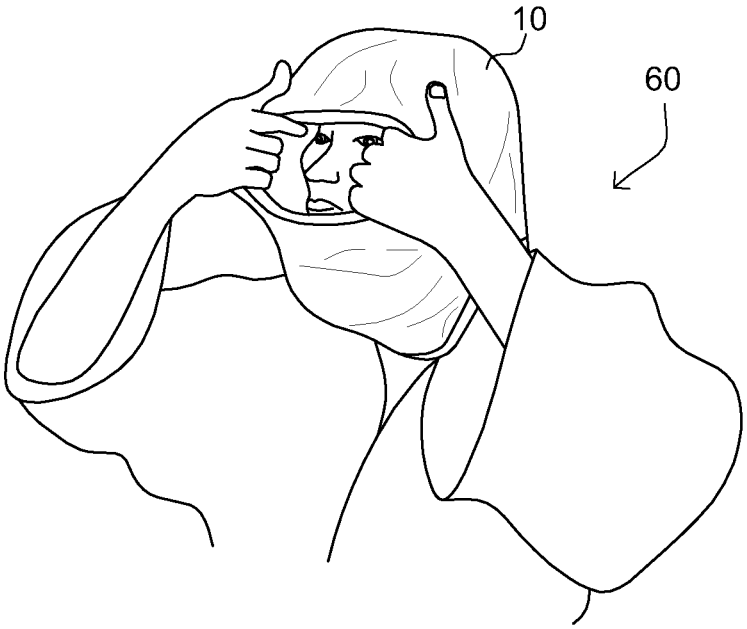
FIG. 3 is a perspective view of an absorbent sleeve disposed over a user's head, according to one embodiment of the invention.

FIG. 3 is a perspective view of an absorbent sleeve disposed over a user's head, according to one embodiment of the invention. There is shown an absorbent sleeve 10 disposed over a user's head 60 and substantially enclosing the same. Such is a non-limiting example of placement of a sleeve over the head of a user in preparation for use thereof in drying the person.

The illustrated absorbent sleeve 10 is configured to rest above a shoulder of a user and enable a user to envelop a user's head, thereby enabling the user to absorb fluids that are disposed thereon by manual manipulation thereof, without the absorbent sleeve 10 being in substantial contact with other parts of a user's body. The absorbent sleeve 10 includes a cylindrical member configured to fit over a user's head through a first aperture and through a second aperture. As illustrated in FIG. 3, the user pulls the first aperture of the absorbent sleeve 10 over the user's head and disposes the user's head through the cylindrical member of the absorbent sleeve 60. The first aperture includes a first cinch loop configured to expand and retract over a user's head.

Figure 4:
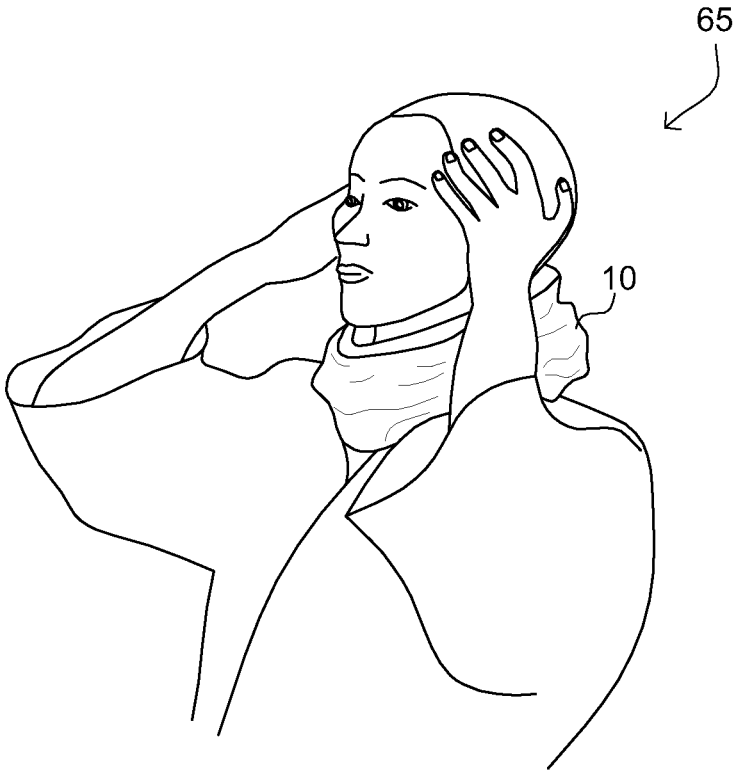
FIG. 4 is a perspective view of an absorbent sleeve disposed about a user's neck and hair, according to one embodiment of the invention.

FIG. 4 is a perspective view of an absorbent sleeve disposed about a user's neck and hair, according to one embodiment of the invention. There is shown an absorbent sleeve 10 disposed about a neck region of a user.

The illustrated absorbent sleeve 10 is configured to rest above a shoulder of a user and enable a user to envelop a user's head, thereby enabling the user to absorb fluids that are disposed thereon by manual manipulation thereof, without the absorbent sleeve 10 being in substantial contact with other parts of a user's body. The absorbent sleeve 10 includes a cylindrical member configured to fit over a user's head through a first aperture and through a second aperture. As illustrated in FIG. 4, the user pulls the second aperture of the absorbent sleeve 10 over the user's head and disposes the cylindrical member of the absorbent sleeve around the neck region of a user 65. The second aperture includes a second cinch loop configured to expand and retract over a user's head.

Figure 5:
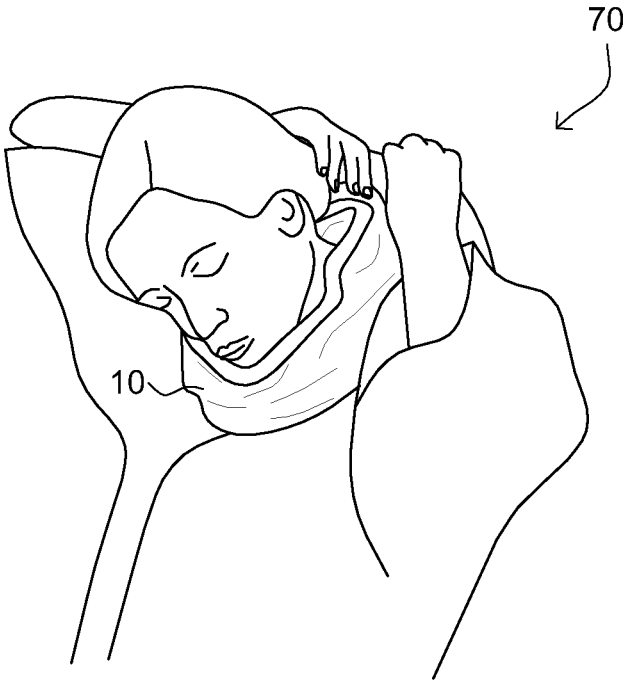
FIG. 5 is a perspective view of absorbent sleeve disposed about a user's neck, according to one embodiment of the invention.

FIG. 5 is a perspective view of absorbent sleeve disposed about a user's neck, according to one embodiment of the invention. There is shown an absorbent sleeve 10 disposed about a user's neck region.

The illustrated absorbent sleeve 10 is configured to rest above a shoulder of a user and enable a user to envelop a user's head, thereby enabling the user to absorb fluids that are disposed thereon by manual manipulation thereof, without the absorbent sleeve 10 being in substantial contact with other parts of a user's body. The absorbent sleeve 10 includes a cylindrical member configured to fit over a user's head through a first aperture and through a second aperture. As illustrated in FIG. 5, the user pulls the user's hair from the cylindrical member of the absorbent sleeve 10, thereby disposing the hair on the outside of the absorbent sleeve 70.

Figure 6:
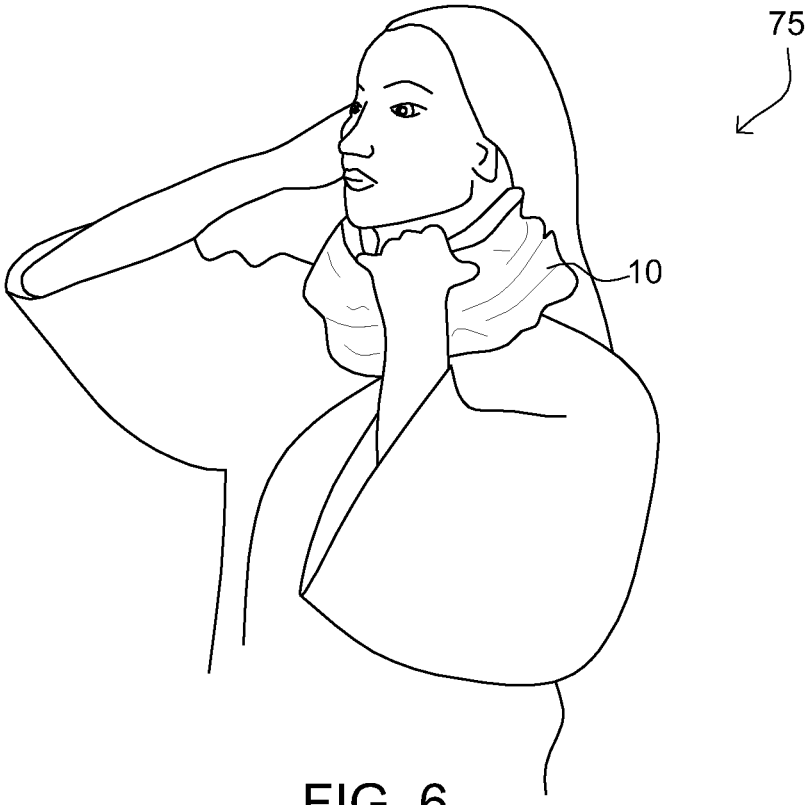
FIG. 6 is a perspective view of an absorbent sleeve disposed about a user's neck, wherein a user's hair is disposed outside of the absorbent sleeve, according to one embodiment of the invention.

FIG. 6 is a perspective view of an absorbent sleeve disposed about a user's neck, wherein a user's hair is disposed outside of the absorbent sleeve, according to one embodiment of the invention. There is shown an absorbent sleeve 10 disposed about a neck region of a user.

The illustrated absorbent sleeve 10 is configured to rest above a shoulder of a user and enable a user to envelop a user's head, thereby enabling the user to absorb fluids that are disposed thereon by manual manipulation thereof, without the absorbent sleeve 10 being in substantial contact with other parts of a user's body. The absorbent sleeve 10 includes a cylindrical member configured to fit over a user's head through a first aperture and through a second aperture. As illustrated in FIG. 6, the user grasps the second aperture about the second cinch loop with the user's hands 75.

Figure 7:
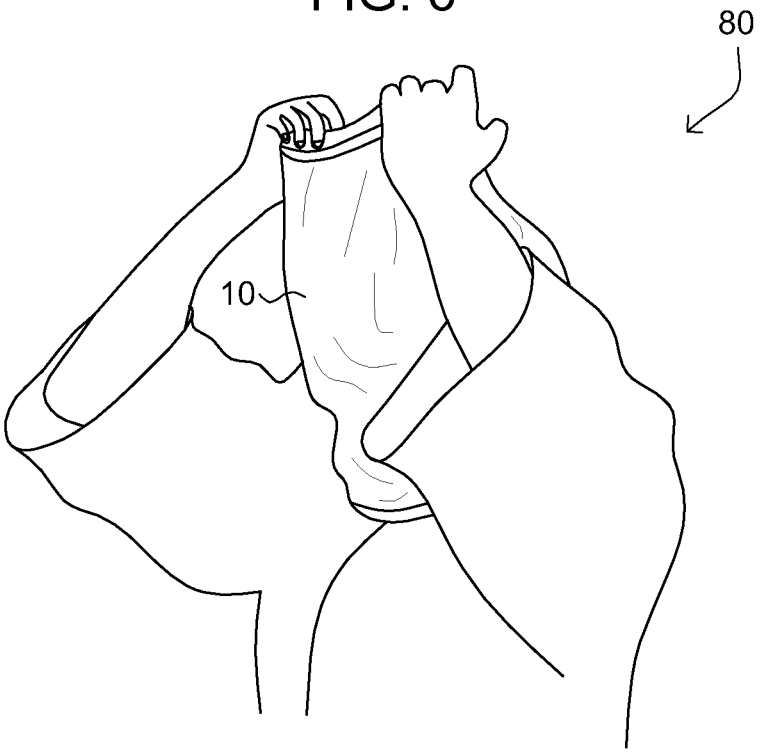
FIG. 7 is a perspective view of an absorbent sleeve pulled over a user's face, according to one embodiment of the invention.

FIG. 7 is a perspective view of an absorbent sleeve pulled over a user's face, according to one embodiment of the invention. There is shown an absorbent sleeve 10 disposed about a user's head.

The illustrated absorbent sleeve 10 is configured to rest above a shoulder of a user and enable a user to envelop a user's head, thereby enabling the user to absorb fluids that are disposed thereon by manual manipulation thereof, without the absorbent sleeve 10 being in substantial contact with other parts of a user's body. The absorbent sleeve 10 includes a cylindrical member configured to fit over a user's head through a first aperture and through a second aperture. As illustrated in FIG. 7, the user pulls up on the second cinch loop, thereby disposing the cylindrical member over a user's face 80.

Figure 8:
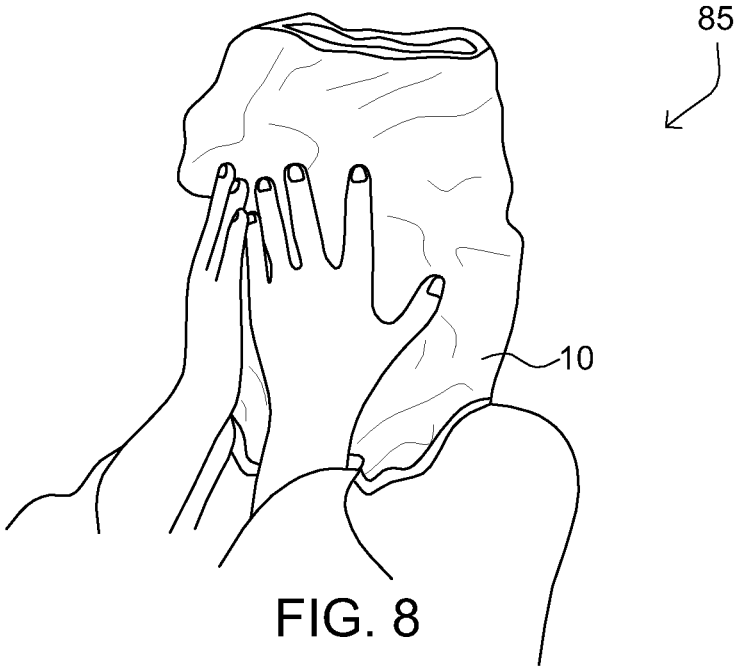
FIG. 8 is a perspective view of an absorbent sleeve drying a user's face, according to one embodiment of the invention.

FIG. 8 is a perspective view of an absorbent sleeve drying a user's face, according to one embodiment of the invention. There is shown an absorbent sleeve 10 disposed over a user's head.

The illustrated absorbent sleeve 10 is configured to rest above a shoulder of a user and enable a user to envelop a user's head, thereby enabling the user to absorb fluids that are disposed thereon by manual manipulation thereof, without the absorbent sleeve 10 being in substantial contact with other parts of a user's body. The absorbent sleeve 10 includes a cylindrical member configured to fit over a user's head through a first aperture and through a second aperture. As illustrated in FIG. 8, the user dries a user's face with an interior surface of the cylindrical member 85. Wherein a sleeve includes a water resistant/proof layer disposed between adjacent layers of absorbent material, the sleeve may be turned inside-out for a fresh and unwetted sleeve that may be used, for example, but a second person. Such a sleeve may include colored layers. As a non-limiting example, a sleeve may include a blue side and a pink side to enable different users to each use the same sleeve before washing the same without coming into facial contact with the same material during use.

Figure 9:
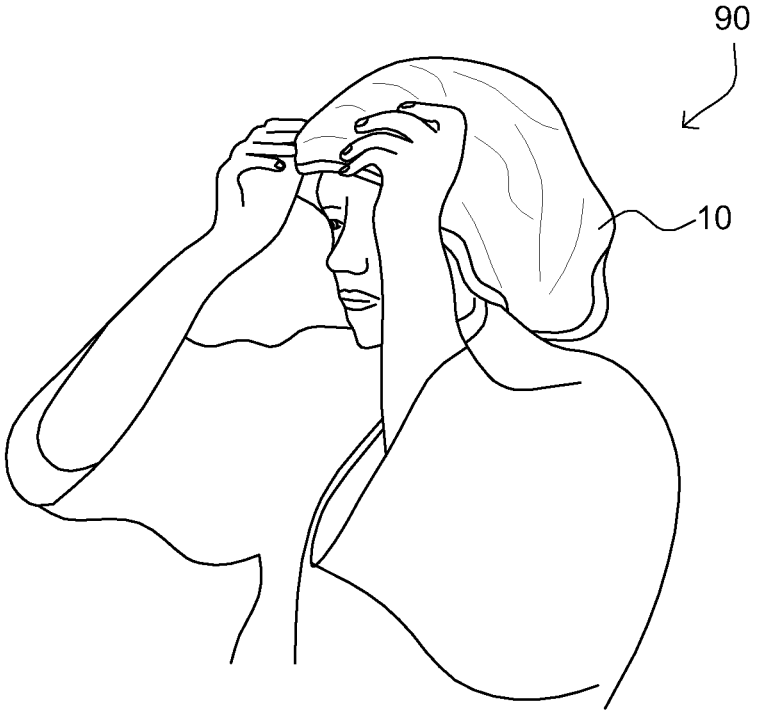
FIG. 9 is a perspective view of an absorbent sleeve disposed about a user's hair, according to one embodiment of the invention.

FIG. 9 is a perspective view of an absorbent sleeve disposed about a user's hair, according to one embodiment of the invention. There is shown an absorbent sleeve 10 disposed about a user's head.

The illustrated absorbent sleeve 10 is configured to rest above a shoulder of a user and enable a user to envelop a user's head, thereby enabling the user to absorb fluids that are disposed thereon by manual manipulation thereof, without the absorbent sleeve 10 being in substantial contact with other parts of a user's body. The absorbent sleeve 10 includes a cylindrical member configured to fit over a user's head through a first aperture and through a second aperture. As illustrated in FIG. 9, the user pulls the user's head through the first aperture and secures a cinch loop around a forehead region of a user, thereby disposing the hair within the cylindrical member 90. The user may additionally secure a cinch loop against the end of the hair, thereby trapping the hair inside the sleeve.

Figure 10:
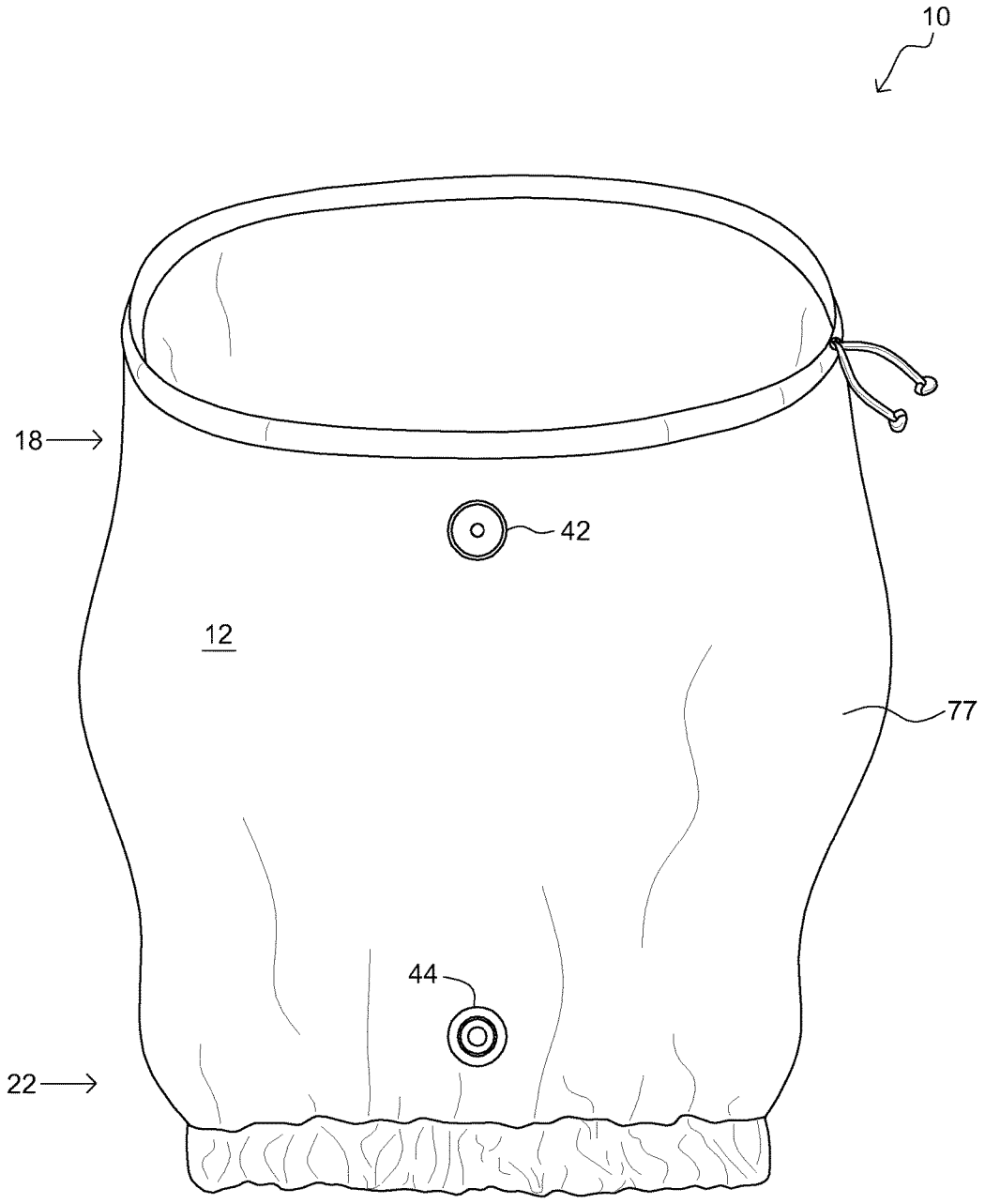
FIG. 10 is a perspective view of an absorbent sleeve, according to one embodiment of the invention.

FIG. 10 is a perspective view of an absorbent sleeve, according to one embodiment of the invention. There is shown an absorbent sleeve 10 including a cylindrical member 12 with a pair of fasting members (coupling and receiving members) coupled at an exterior surface thereto.

The illustrated absorbent sleeve 10 includes a cylindrical member 12 configured to fit over a user's head. The cylindrical member 12 includes a waterproof layer 77 disposed on an exterior surface thereof. The waterproof layer 77 is configured to keep water from saturating an interior surface from an exterior surface of the cylindrical member 12 The illustrated cylindrical member 12 includes a coupling member 42 disposed about a first end 18 of the cylindrical member 12. The cylindrical member 12 includes a receiving member 44 disposed about a second end 22 of the cylindrical member 12. The coupling and receiving members 42 and 44 may be mated devices that selectably couple one to the other, thereby permitting the user to create a "turban" styled configuration wherein the hair is bunched. Such coupling and receiving or fastening members include but are not limited to buttons, snaps, hook and loop fasteners, ties, and the like and combinations thereof.

In operation of one embodiment of the invention, a user takes a shower or a bath and prepares to dry their face and hair afterwards. The user disposes the absorbent sleeve over the user's head and disposes the absorbent sleeve around the neck region of the user, by positioning the head through the first and second apertures of the cylindrical member. The user pulls out their hair from the absorbent sleeve thereby disposing the hair outside thereof. The user pulls the absorbent sleeve back over the user's face through the second aperture and dries the user's face with the interior surface of the absorbent sleeve. The user then pulls the absorbent sleeve over the user's face through the first aperture and disposes the absorbent sleeve over the user's hair. The user dries the hair with the interior of the absorbent sleeve. The absorbent sleeve is configured to securely hold the user's hair away from the user's face. The user couples the coupling member of the first end to the receiving member of the second end of the cylindrical member, thereby creating a simple non-twist turban configured to keep longer hair on top of the user's hard and not down and out of the second aperture.

In one embodiment, a sleeve may provide warmth and comfort, such as but not limited to after swimming. Further, a sleeve may facilitate drying hair and keeping damp hair off other surfaces (including but not limited to shoulders and clothing). Advantageously, a sleeve does not require a user to twist or tangle their hair during the use thereof.

The following are non-limiting examples of use of a sleeve having dual elastic ends in various situations:

Exemplary Process for Long Hair:

After bathing, one of the elastic ends goes around the user's head to hold it in place.

The Sleeve is pulled down around the neck of the user like a neck warmer.

The user pulls long hair up to the outside of the Sleeve

The user then pulls the Sleeve up back on top of the head thus enclosing the hair inside the Sleeve The user can now scrunch and wring the Sleeve on the outside of the hair to dry hair Exemplary Process for Short Hair:

After bathing, one of the elastic ends goes around the user's head to hold it in place.

The Sleeve can be used to dry the face and head by pulling down one of the elastic ends around the neck, thus covering the head with the Sleeve, and patting or rubbing the outside of the Sleeve to dry the user's head and hair which is inside the Sleeve.

The Sleeve is then pulled back on top of the head where it keeps the head warm.

Figure 11:
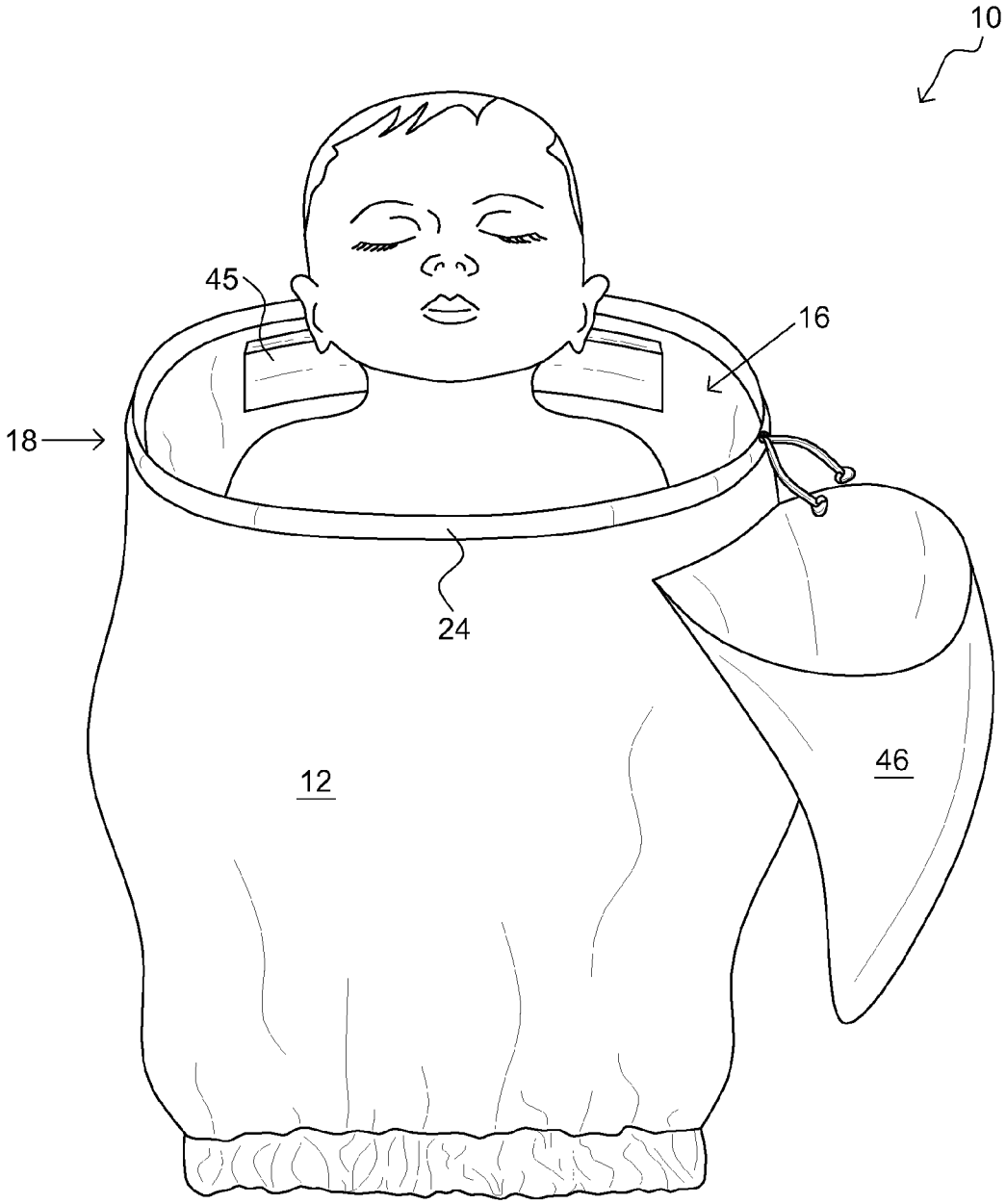
FIG. 11 is a perspective view of an absorbent sleeve disposed about an infant, according to one embodiment of the invention.

FIG. 11 is a perspective view of an absorbent sleeve disposed about an infant, according to one embodiment of the invention. There is shown an absorbent sleeve 10 including a hood 46.

The illustrated absorbent sleeve 10 includes a cylindrical member 12. The cylindrical member 12 includes a first aperture 16 disposed about a first end 18. The cylindrical member 12 includes a first cinch loop 24 disposed around the perimeter of the first aperture 16. The cylindrical member 12 includes a hood 46 coupled to the cylindrical member and configured to be disposed over the first aperture 16. The hood may be coupled along a linear portion of the hood near a top portion of the cylindrical member. The absorbent sleeve 10 includes a padded member 45 disposed substantially around the first aperture and is configured to provide a cushion for a user.

In operation of one embodiment of the invention, a user gives a baby or infant a bath and places the baby/infant within the absorbent sleeve afterwards. The user dries off the baby using the interior surface of the absorbent sleeve. The user disposes the hood over the baby/infant's head to protect the baby/infant from getting cold after a bath. The user cinches up the first cinch loop thereby insulating the baby/infant within the cylindrical member.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although specific cinch loops/devices are illustrated, it is understood that any combination of cinch loops/devices may be present in varying embodiments, and additional cinch loop/devices may be present as well.

Additionally, although the figures illustrate particular uses of the invention, it is understood that the invention may be used in plethoric ways. In non-limiting particulars, it is understood that the head towel may be oriented differently in use and may even be reversible.

It is also envisioned that the "cylindrical member" may have a square, triangular, polygonal, irregular, ovoid, oval, or otherwise not strictly circular cross-section.

It is expected that there could be numerous variations of the design of this invention. An example is that the specific dimensions, patterns, and designs may vary according to many factors including but not limited to aesthetics, branding, cultural needs, decorative intentions, and the like and combinations thereof.

Finally, it is envisioned that the components of the device may be constructed of a variety of materials, including but not limited to natural fibers (cotton, wool, hemp, wood, silk, asbestos, latex, and etc.), synthetic/artificial fibers (polyester, rayon, nylon, carbon fiber, rubber, glass, metallic, elastane/spandex, and etc.), microfibers, plastics, metals, minerals, wood, ceramic, composite, and the like and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. An absorbent sleeve configured to rest above a shoulder of a user and to enable a user to envelop a user's head, thereby enabling the user to absorb fluids disposed thereon by manual manipulation thereof, without the sleeve being in substantial contact with other parts of a user's body, consisting essentially of:

a) a cylindrical member having a cross-sectional area between about 200 cm^2 and about 450 cm^2, and a height between about 20 cm and about 30 cm, consisting essentially of:
  a1) a looped layer of absorbent material;
  a2) a first aperture through a first end of the cylindrical member; and
  a3) a second aperture through a second end of the cylindrical member, opposite the first end;

b) a first cinch loop coupled about the first aperture of the cylindrical member and consisting essentially of:
  b1) a first mode, wherein a cross-sectional area of the first cinch loop is substantially smaller than the cross-sectional area of the cylindrical member; and
  b2) a second mode, wherein a cross-sectional area of the first cinch loop is substantially equal to the cross-sectional area of the cylindrical member; and c) an elastic loop coupled about the second aperture of the cylindrical member and consisting essentially of:
  c1) a first mode, wherein a cross-sectional area of the elastic loop is substantially smaller than the cross-sectional area of the cylindrical member; and
  c2) a second mode, wherein a cross-sectional area of the elastic loop is substantially equal to the cross-sectional area of the cylindrical member; and wherein the absorbent sleeve does not include a hood.

2. The sleeve of claim 1, wherein the first cinch loop is a drawstring.

3. The sleeve of claim 1, wherein the cylindrical member includes a waterproof layer disposed on an exterior surface thereof.

4. An absorbent sleeve configured to rest above a shoulder of a user and to enable a user to envelop a user's head, thereby enabling the user to absorb fluids disposed thereon by manual manipulation thereof, without the sleeve being in substantial contact with other parts of a user's body, comprising:

a) a cylindrical member having a cross-sectional area between about 200 cm^2 and about 450 cm^2, and a height between about 20 cm and about 30 cm, comprising:
  a1) a looped layer of absorbent material;
  a2) a first aperture through a first end of the cylindrical member; and a3) a second aperture through a second end of the cylindrical member, opposite the first end; and b) a first cinch loop coupled about the first aperture of the cylindrical member and having:

b1) a first mode, wherein a cross-sectional area of the first cinch loop is substantially smaller than the cross-sectional area of the cylindrical member; and b2) a second mode, wherein a cross-sectional area of the first cinch loop is substantially equal to the cross-sectional area of the cylindrical member; and c) a second member consisting essentially of an elastic loop; and wherein the absorbent sleeve does not include a hood.

5. The sleeve of claim 4, wherein the elastic loop is coupled about the second aperture of the cylindrical member and includes:

a) a first mode, wherein a cross-sectional area of elastic loop is substantially smaller than the cross-sectional area of the cylindrical member; and b) a second mode, wherein a cross-sectional area of the elastic loop is substantially equal to the cross-sectional area of the cylindrical member.

6. The sleeve of claim 4, wherein the first cinch loop is a drawstring.

7. The sleeve of claim 4, wherein the cylindrical member includes a waterproof layer disposed on an exterior surface thereof.

* * * * *